US005730764A

United States Patent [19]

Williamson et al.

[11] Patent Number: 5,730,764

[45] Date of Patent: Mar. 24, 1998

[54] COATED ABRASIVE SYSTEMS EMPLOYING IONIZING IRRADIATION CURED EPOXY RESINS AS BINDER

[76] Inventors: Sue Ellen Williamson, 1690 Granger Ct., Chamblee, Ga. 30341; Richard R. Kemmerer, 862 Chestnut Lake Dr., Marietta, Ga. 30068

[21] Appl. No.: 788,961

[22] Filed: Jan. 24, 1997

[51] Int. Cl.[6] ..... B24D 3/02; B24D 3/34

[52] U.S. Cl. ..... 51/295; 51/298; 51/306; 430/913; 430/914; 522/31

[58] Field of Search ..... 51/295, 298, 306; 430/270.1, 280.1, 286.1, 913, 914; 522/15, 25, 31

[56] References Cited

U.S. PATENT DOCUMENTS

| | | | |
|---|---|---|---|
| 4,047,903 | 9/1977 | Hesse et al. | 51/298 |
| 4,457,766 | 7/1984 | Caul | 51/298 |
| 4,588,419 | 5/1986 | Caul et al. | 51/295 |
| 4,640,937 | 2/1987 | Hanyuda | 522/31 |
| 4,735,632 | 4/1988 | Oxman et al. | 51/295 |
| 4,751,138 | 6/1988 | Tumey et al. | 428/323 |
| 4,828,583 | 5/1989 | Oxman et al. | 51/295 |
| 4,836,832 | 6/1989 | Tumey et al. | 51/293 |
| 4,985,340 | 1/1991 | Palazzotto et al. | 430/270 |
| 5,073,643 | 12/1991 | Crivello | 556/64 |
| 5,079,378 | 1/1992 | Crivello | 556/64 |
| 5,144,051 | 9/1992 | Kessel et al. | 556/64 |
| 5,571,297 | 11/1996 | Swei et al. | 51/298 |
| 5,578,343 | 11/1996 | Gaeta et al. | 427/202 |

FOREIGN PATENT DOCUMENTS 1 956 810 7/1971 Germany .

OTHER PUBLICATIONS

Heloxy® Epoxy Functional Modifers; Product Brochure Shell Chemical Company SC:1928–95 1995 (no month).

Lubin, Handbook of Composites, Van Nostrand Reinhold Company, Inc. New York, New York, (1982) pp. 61–63.

*Primary Examiner*—Deborah Jones

*Attorney, Agent, or Firm*—Wenderoth, Lind & Ponack

[57] ABSTRACT

Coated abrasive products are disclosed in which an ionizing irradiation curable epoxy resin formulation is employed as an abrasive binder. The ionizing irradiation curable epoxy resin formulation contains an onium salt initiator and is employed as at least one of the coatings of the coated abrasive product.

16 Claims, No Drawings

COATED ABRASIVE SYSTEMS EMPLOYING IONIZING IRRADIATION CURED EPOXY RESINS AS BINDER

The present invention resides in the field of coated abrasive systems and provides for the use of ionizing irradiation cured epoxy resins as binders in such systems.

BACKGROUND OF THE INVENTION

Coated abrasive products generally comprise a backing and abrasive granules supported thereby and adhered thereto. The backing may be paper, cloth, polymeric film, vulcanized fiber, etc. or a combination of two or more of these materials. The abrasive granules may be formed of flint, garnet, aluminum oxide, alumina-zirconia, diamond, silicon carbide, etc.. Binders for the purpose of adhering the granules to the backing conventionally include phenolic resins, hide glue, varnish, epoxy resins, urea-formaldehyde resins, and polyurethane resins.

The coated abrasive may employ a "make" coat of resinous binder material which is utilized to secure the ends of the abrasive granules onto the backing as the granules are oriented and a "size" coat of resinous binder material over the make coat which provides for firm adherent bonding of the abrasive granules. The size coat resin may be of the same material as the make coat resin or it may be of a different resinous material.

In the manufacture of conventional coated abrasives, the make coat resinous binder is first applied to the backing, the abrasive granules are then applied, the make coat is partially cured, the size coat resinous binder is then applied, and finally, the construction is fully cured. Generally, thermally curable binders provide coated abrasives having excellent properties, e.g., heat resistance. Thermally curable binders include phenolic resins, epoxy resins, and alkyd resins. With backings formed of polyester or cellulose, however, curing temperatures are limited to a maximum of about 130° C. At this temperature, cure times are sufficiently long to necessitate the use of festoon curing areas. Festoon curing areas are disadvantageous in that they result in formation of defects at the suspension rods, inconsistent cure due to temperature variations in the large festoon ovens, sagging of the binder, and shifting of abrasive granules. Furthermore, festoon curing areas require large amounts of space and large amounts of energy. Accordingly, it would be desirable to develop a resin that does not require a great deal of heat to effect cure.

Radiation curable resins are known in the art. DEOS No. 1,956,810 discloses the use of radiation for the curing of unsaturated polyester resins, especially in mixtures with styrene as binder for abrasives. U.S. Pat. No. 4,047,903 discloses a radiation curable binder comprising a resin prepared by at least partial reaction of (a) epoxy resins having at least 2 epoxy groups, e.g., from diphenylolpropane and epichlorohydrin, with (b) unsaturated monocarboxylic acids, and (c) optionally polycarboxylic acid anhydride. U.S. Pat. No. 4,457,766 discloses the use of acrylated epoxy resins, which are designated therein "epoxy acrylates", such as the diacrylate esters of bisphenol A epoxy resins, as a radiation curable binder for coated abrasives.

The coated abrasives described in the foregoing patents exhibit the shortcoming of poor adhesion of abrasive granules to the backing because the binder does not cure in areas where the granules screen out radiation, unless high dosages of ionizing radiation are employed. High dosages of radiation can adversely affect the backing. The poor adhesion of the abrasive granules results in a large loss of abrasive granules, i.e., "shelling", from the backing upon flexing and grinding. Attempts to improve the adhesion of the abrasive granules by curing by ionizing radiation, e.g., electron beam (EB) through the backside of the backing often leads to degradation of the backing. See U.S. Pat. No. 4,751,138.

There are a few disclosures of the electron beam (EB) curing of abrasive binders, however, in all cases the cure of the binder is via a free radial mechanism. See U.S. Pat. No. 4,457,766. Two patents also list the use of iodonium salts in the cure of an abrasive binder system (U.S. Pat. Nos. 4,828,583 and 4,735,632), however, the iodonium salt is used as part of a ternary photoinitiator system for (meth) acrylate monomers only (not as a cationic initiator), and it is said to be ineffective for EB cure. Also, U.S. Pat. Nos. 5,578,343 and 5,571,297 disclose a dual cure system. EB cures acrylate functionality and heat is used to complete the cure of epoxy or other functionality. Finally, U.S. Pat. Nos. 4,836,832 and 4,751,138 disclose UV radiation hybrid cure of epoxide and ethylenically unsaturated materials.

While resole phenolic materials commonly used as binders have excellent physical properties after cure, the cure process requires heating at elevated temperatures for many hours, requiring a large energy input. The ovens required are very large, thus requiring huge capital outlay for increasing capacity. In addition, resole phenolics release phenol and formaldehyde vapors on cure. Since long cure times are required, sizable inventories of finished and intermediate abrasive product must be maintained by the abrasive products manufacturers.

The present invention will allow rapid cure of coated abrasive articles.

The invention will offer the following advantages versus conventional process (thermal cured phenolics):

- Reduced cure times will allow production flexibility for abrasive materials, reducing the amount of finished coated abrasive inventory required to be on hand.
- Energy costs for production of abrasives will be reduced.
- Additional capacity can be added at much less expense than for new ovens.
- Toxic off-gases (phenol and formaldehyde) produced during cure will be eliminated.

The invention offers the following advantages over similar UV cured processes:

- Cure by UV irradiation is limited to systems transparent to the wavelengths absorbed by the initiating species.
- Most commercially available cationic initiators do not absorb light above 350 nm, and in some cases much above 300 nm, preventing their use in pigmented systems and limiting the depth of cure available.
- Ionizing irradiation penetrates substrates regardless of color, allowing the cure of heavily coated and/or pigmented systems.
- Ionizing irradiation can penetrate particulate material, such as abrasive grit and fillers.

DESCRIPTION OF THE INVENTION

The present invention provides coated abrasive products or systems which employ as an abrasive binder, a binder made from an epoxy resin or resins with a cationic initiator and which are cured (crosslinked) by ionizing irradiation, e.g., Electron Beam (EB), gamma ray or X-ray irradiation. The abrasive binder employed in the invention comprises an epoxy resin or mixture of epoxy resins in an amount of 1 to 99.5% by weight of the total binder formulation and at least one onium salt initiator in an amount of 0.1 to 10% by weight of the total binder formulation.

The epoxy resin or resins to be employed can be selected from any of a large variety of commercially available materials.

In particular, the epoxy resin can include those from any of the following glycidyl ethers:

1. Diglycidyl ethers of Bisphenol A of the formula

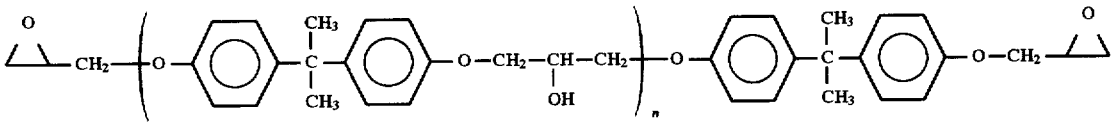

where n=0 to 10.

These resins are available from a number of manufacturers such as Shell Chemical Company DOW Chemical Company, and Ciba-Geigy Corporation in a variety of molecular weights and viscosities. Examples include: D.E.R. 332, D.E.R. 330, D.E.R. 331, D.E.R. 383, Tactix 123, Tactix 138, and Tactix 177 (DOW trademarks); Epon 825, Epon 826, and Epon 828 (Shell trademarks); and, Araldite GY 6008, Araldite GY 6010, and Araldite GY 2600 (Ciba-Geigy trademarks).

2. Diglycidyl ethers of Bisphenol F and Epoxy Phenol Novolacs of the formula:

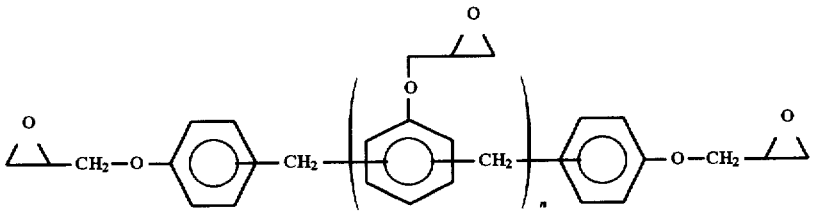

Diglycidyl ethers of Bisphenol F, n=0, Epoxy Phenol Novolacs, n>0.

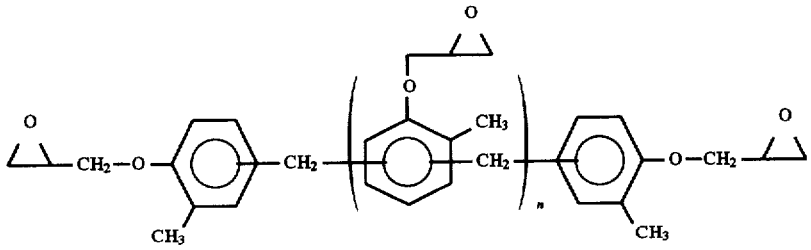

These materials are available from a number of different manufacturers in a variety of molecular weights and viscosities. Examples include: Epon 155, Epon 160, Epon 861 and Epon 862 (Shell trademarks), DEN 431, DEN 436, DEN 438, DEN 439, DEN 444, and Tactix 785 (Dow trademarks), Araldite PY 306, Araldite EPN 1138, Araldite EPN 1139, Araldite EPN 1179, Araldite EPN 1180, Araldite EPN 9880, Araldite GY 281, Araldite GY 282, Araldite GY 285, Araldite GY 308, Araldite LY 9703, Araldite PY 307, and Araldite XD 4995 (Ciba Geigy trademarks), and Epalloy 8230, Epalloy 8240, Epalloy 8250, Epalloy 8330, and Epalloy 8350 (CVC Specialty Chemicals trademarks).

as well as Epoxy Cresol Novolacs of the formula where n>0.

Epoxy Cresol Novolacs are available from a number of different manufacturers in a variety of molecular weights and viscosities. Examples include: Epon 164 and Epon RSS-2350 (Shell trademarks), and Araldite ECN 1235, Araldite ECN 1273, Araldite ECN 1280, Araldite ECN 1282, Araldite ECN 1299, Araldite ECN 1400, Araldite

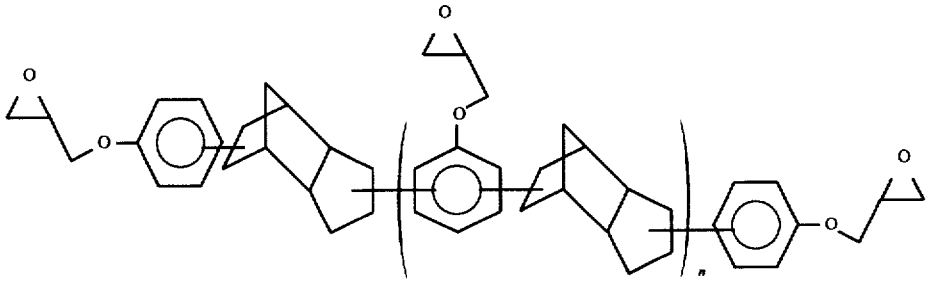

ECN 1871, Araldite ECN 1873, Araldite ECN 9511 and Araldite ECN 9699 (Ciba Geigy trademarks).

and Bisphenol A Epoxy Novolacs of the formula

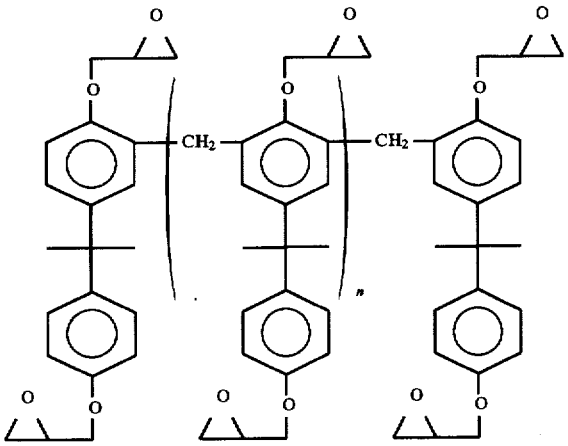

where n=0 to about 2 or more.

Bisphenol A epoxy novolacs are commercially available in a variety of molecular weights and viscosities as the SU series of resins (Shell Chemical trademark).

3. Tetraglycidyl ether of tetrakis (4-hydroxyphenyl) ethane of the formula

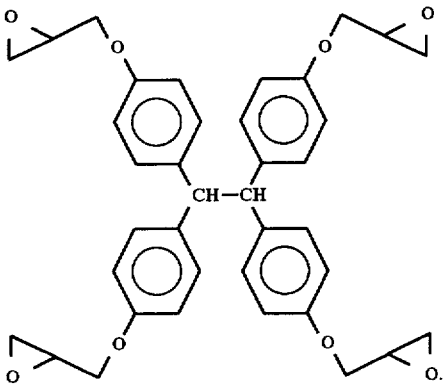

This is commercially available as Epon 1031 (Shell Chemical Trademark) and Araldite MT 0163 (Ciba-Geigy trademark).

4. Glycidyl ethers of the condensation product of dicyclopentadiene and phenol of the formula This product is commercially available as Tactix 556 (DOW Chemical trademark) where n is approximately 0.2.

5. Triglycidyl ether of tris(hydroxyphenyl)methane of the formula

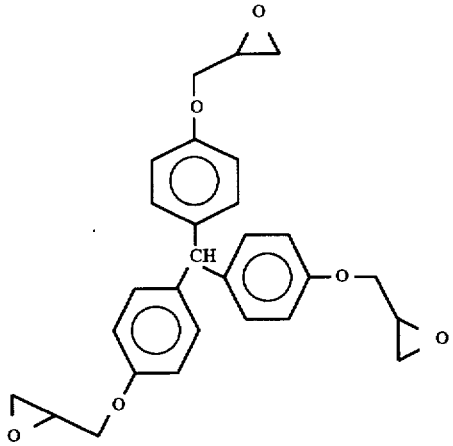

This product is available as Tactix 742 (DOW Chemical trademark).

These materials can be used alone or as mixtures of several of the materials.

The epoxy resin can include those from any of the following cycloaliphatic epoxides of the indicated formulas, either as the main ingredient of the binder formulation or as a diluent:

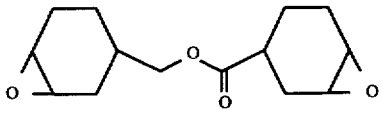

3',4'-epoxycyclohexylmethyl 3,4-epoxycyclohexanecarboxylate [available as ERL-4221, Cyracure UVR-6110 and UVR 6105 (Union Carbide Corporation trademarks), Araldite CY-179 (Ciba-Geigy trademark), Uvacure 1500 (UCB trademark) and as Celloxide 2021 (Daicel Chemical Industries Ltd. trademark)].

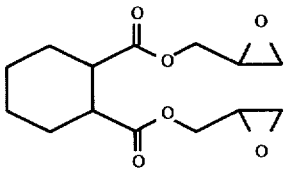

Diglycidyl ester of hexahydrophthalic anhydride [available as CY 184 (Ciba-Geigy trademark)],

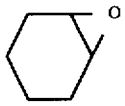

Cyclohexene oxide,

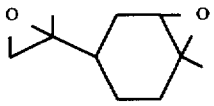

Limonene diepoxide [available as Celloxide 3000 (Daicel Chemical Industries Ltd. trademark)].

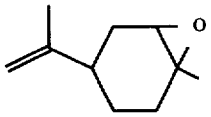

Limonene monoxide,

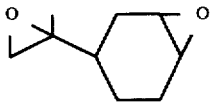

Vinyl cyclohexene dioxide [available as ERL-4206 (Union Carbide Corporation trademark)].

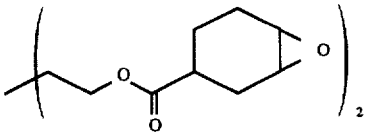

Bis(3,4-epoxycyclohexylmethyl) adipate [available as ERL-4299 (Union Carbide trademark)],

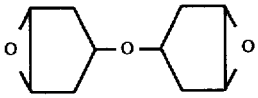

Bis (2,3-epoxy cyclopentyl) ether,

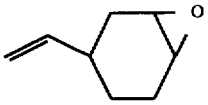

Vinyl cyclohexene oxide [available as Celloxide 2000 (Daicel Chemical Industries Ltd. trademark)],

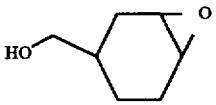

(3,4-epoxy cyclohexene) methyl alcohol [available as ETHB (Daicel Chemical Industries Ltd. trademark)],

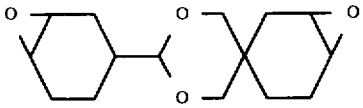

2-(3,4-Epoxycyclohexyl 5,5-spiro-3,4-epoxy) cyclohexane-metadioxane [available as ERL-4234 (Union Carbide Corporation trademark)],

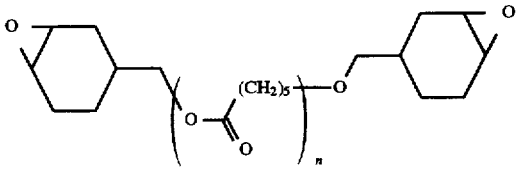

where n>1, 3,4-Epoxycyclohexylmethyl-3',4' epoxycyclohexanecarboxylate modified ϵ-caprolactone [available in various molecular weights as Celloxide 2081, Celloxide 2083, and Celloxide 2085 (Daicel Chemical Industries Ltd. trademarks)],

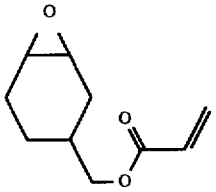

(3,4-Epoxy cyclohexyl) methyl acrylate [available as Cyclomer A-200 (Daicel Chemical Industries Ltd. trademark)], and

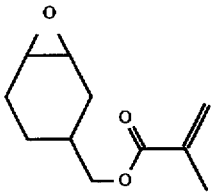

(3,4-Epoxy cyclohexyl) methyl methacrylate [available as Cyclomer M-100 (Daicel Chemical Industries Ltd. trademark)].

These materials can also be used alone or as mixtures.

The epoxy resins can include polymers with pendent epoxy or cycloaliphatic epoxide groups.

The epoxy resin may also include those from the epoxides of the following structures:

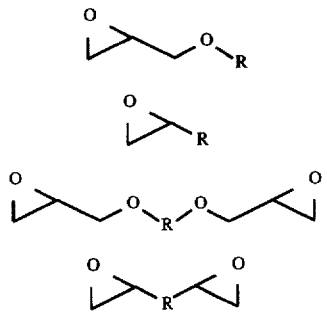

wherein R is a monovalent or bivalent radical. To illustrate, R may be alkyl of up to about 14 carbon atoms, e.g., butyl, heptyl octyl, 2-ethyl hexyl and the like. R may also be phenyl or alkyl-phenyl such as, for example, cresyl, t-butyl phenyl and nonylphenyl. R may also be linear or branched alkylene such as, for example, allyl. R can further be bivalent linear or branched structures containing the groups $(CH_2CH_2O)_n$, $(CH_2CH_2CH_2O)_n$ and the like, wherein n may be, for example, up to about 10.

These materials are commonly used, commercially available epoxy reactive diluents and functional modifiers. Specific examples of these materials may be found in *Handbook of Composites*, Edited by George Lubin, Van Nostrand Reinhold Company, Inc., New York, N.Y. (1982), pages 61 to 63, and Shell Chemical Company technical brochure SC-1928-95, HELOXY® Epoxy Functional Modifiers.

Certain of the epoxy materials are either high viscosity liquids or solids at room temperatures. Therefore, it is contemplated that the higher viscosity materials may be blended with lower viscosity epoxy materials or with reactive or non-reactive diluents as discussed below in order to achieve the desired viscosity for ease in processing. Heating may be required to achieve the desired flow properties of the uncured formulation but temperatures should not be sufficiently high to cause thermal curing of the epoxy group. Specific blends have been found to have a good overall combination of low viscosity in the uncured states and high glass transition temperature, flexural strength and modulus when cured. One blend which can be mentioned is a high performance semi-solid epoxy such as Tactix 556 with lower viscosity bisphenol A or bisphenol F based glycidyl ether epoxies such as Tactix 123 or Epon 861, respectively.

The initiator, which is employed in the binder formulation in an amount of 0.1 to 10% by weight of the formulation, comprises an onium cation and an anion containing a complex anion of a metal or metalloid.

The onium cation may include:

Diaryl salts of group VIIa elements

Triaryl salts of group VIa elements

Other onium salts of group VIa elements

Other onium salts which can be activated by ionizing irradiation and combinations thereof.

The anion containing a complex anion of a metal or metalloid may be independently selected from the following:

$BF_4^-$, $PF_6^-$, $SbF_6^-$, $B(C_6F_5)_4^-$, $B(C_4H_2(CF_3)_3)_4^-$ and other borate anions as described in U.S. Pat. No. 5,468,902 which is incorporated herein by reference, and combinations thereof.

The initiator, for the present invention is a material which produces a positively charged species (cation) when subjected to ionizing radiation. This positively charged species must then be capable of initiating the cationic polymerization of the epoxy. Much research has been devoted to the development of cationic photoinitiators (J. V. Crivello, *Advances in Polymer Science*, Vol. 62, p. 1 (1984)). Cationic initiators react when subjected to visible or ultraviolet light of a particular wavelength to produce a cationic species, typically a Bronstead acid. It was previously determined that some of these initiators also react to generate cations when subjected to ionizing radiation. Diaryliodonium salts and triarylsulfonium salts of certain anions are particularly effective as initiators for the ionizing radiation induced cationic polymerization of epoxies.

Many examples of each have been reported and some are commercially available. Almost all could be useful in the present invention.

Specific examples of diaryliodonium salts are given by the following formula, where $R_1$ and $R_2$ are radicals such as H, methyl, ethyl, n-propyl, isopropyl, n-butyl, tert-butyl, Cl, Br, $C_nH_{2n+1}$, $OC_nH_{2n+1}$, $OCH_2CH(CH_3)C_nH_{2n+1}$, $OCH_2CH(C_2H_5)C_nH_{2n+1}$, $OCH_2CH(OH)C_nH_{2n+1}$, $OCH_2CO_2C_nH_{2n+1}$, $OCH(CH_3)CO_2C_nH_{2n+1}$, $OCH(C_2H_5)CO_2C_nH_{2n+1}$, and mixtures thereof where n is an integer between 0 and 18:

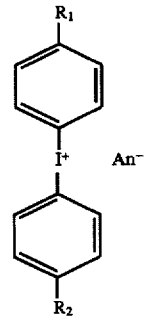

$An^-$ denotes the anion which may be hexafluoroarsenate ($AsF_6$), hexafluoroantimonate ($SbF_6$), hexafluorophosphate ($PF_6$), boron tetrafluoride ($BF_4$), trifluoromethane sulfonate ($CF_3SO_3$), tetrakis (pentafluorophenylborate), ($B[C_6F_5]_4$), or tetrakis [3,5-bis(trifluoromethyl)phenyl]borate ($B[C_6H_3(CF_3)_2]_4$). For example, OPPI used in the examples herein denotes (4-octyloxyphenyl)-phenyliodonium hexafluoroantimonate ($R_1$=H, $R_2$=$OC_8H_{17}$, $An^-$=$SbF_8$). This initiator can be obtained from General Electric Corporation as Aryl Fluoroantimonate Product 479-2092 and was found to be particularly effective with certain epoxy resins. However, initiators with other $R_1$ and $R_2$ substituents would be expected to exhibit similar reactivities. Other diaryl iodonium salts such as are described in U.S. Pat. Nos. 5,144,051, 5,079,378 and 5,073,643 are expected to exhibit similar reactivities.

Specific examples of triarylsulfonium salts are given by the following formulas, where $R_3$ is H, methyl, ethyl, n-propyl, isopropyl, n-butyl, tert-butyl, phenylsulfide (PhS), phenoxy (PhO) and $An^-$ denotes the anion, which may be the same as those of the diaryliodonium salts:

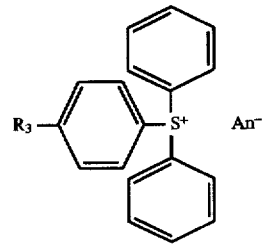

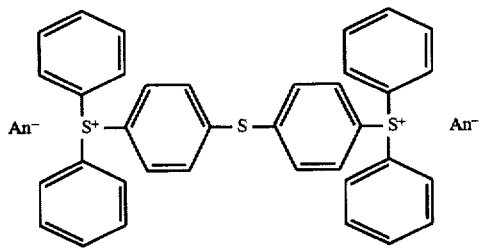

Examples of commercially available triarylsulfonium salts are Cyracure UVI-6974 and Cyracure UVI-6990 which are available from Union Carbide Corporation. These are mixtures of the triarylsulfonium salts given by the formulas where $R_3$ is phenylsulfide and $An^-$ are the hexafluoroantimonate and hexafluorophosphate anions, respectively. Degussa Corporation Degacure KI-85 and 3M Corporation FX-512 are both mixtures of triarylsulfonium hexafluorophosphate salts.

Thermally activated cationic initiators, such as benzyltetra-methylene sulfonium salts or benzyl(p-hydroxyphenyl)methyl-sulfonium salts may also be included as part of the binder formulation. When employed, these materials can be used in an amount of up to about 10% by weight of the total binder formulation.

Reactive diluents may optionally be employed in the formulation in an amount of up to about 40% by weight of the formulation. These include low viscosity epoxides and diepoxides, low viscosity alcohols, polyols and/or phenols, vinyl ethers, vinyl monomers, cyclic ethers such as tetrahydrofuran (THF), cyclic carbonates and esters such as γ-butyrolactone or propylene carbonate, acrylates and methacrylates, and compounds containing more than one reactive functionality in the same molecule.

Solvents may be added to the formulation to adjust the viscosity of the precured formulation to that desired for application. As a general proposition—but not always—solvents would be removed by evaporation (at room temperature, under vacuum or by heating) from the applied formulation film prior to ionizing radiation, e.g., EB, curing. Solvents can be employed in amounts ranging up to about 90% by weight of the formulation.

Alcohols (0 to about 20% by weight), polyols (0 to about 50% by weight) and phenolic compounds (0 to about 40% by weight) may be added to the formulation to modify the uncured rheology or to improve the cured properties of the binder formulation.

Reactive and non-reactive toughening agents may optionally be employed in an amount of up to about 30% by weight of the formulation. These agents are used to increase the impact resistance and modulus of the systems to which they are added.

Reactive toughening agents include materials which have functionality which will react under acid catalyzed conditions such as epoxy and/or hydroxy terminated rubbers.

Non-reactive toughening agents include materials which do not have functionality which will react under acid catalyzed conditions, or which will react poorly under such conditions, such as polybutadienes, polyethersulfones, polyetherimides, and the like.

Mineral fillers may be added. Such fillers are employed in amounts of up to about 70% by weight of the formulation. Fillers include calcium carbonate (at some expense of cure speed), aluminum oxide, amorphous silica, fumed silica, sodium aluminum silicate, clay, etc.. Fillers may be surface treated to increase filling ability, to enhance adhesion to the epoxy resin or to other components of the abrasive binder, and/or to improve properties of the cured film.

The abrasive grit to be employed may be included in the formulation prior to application or may be applied to the make coat following its application and prior to curing. When incorporated into the formulation prior to application, it is employed in an amount of up to about 50% by weight of the formulation.

Abrasive grit may include fused alumina oxide, ceramic aluminum oxide, green silicon carbide, silicon carbide, chromia, alumina zirconia, diamond, iron oxide, ceria, cubic boron nitride, boron carbide, garnet and combinations thereof. Any other synthetic or natural abrasive known to the art may also be used.

The distribution of the abrasive grit on the backing sheet and their average particle size and size distribution can be conventional. They can be oriented or can be applied without orientation.

Pigments or dyes may also be added to the formulation to achieve a desired color or hue. Such materials may be those which are conventionally employed in the art and are used in amounts of up to about 10% by weight of the formulation.

The abrasive binder formulation may be used for any layer of the coated abrasive product or system. This includes the make coat, size coat, super-size coat, front fill, back fill or saturant coat. The formulation can be applied by bar, knife, reverse roll, knurled roll, curtain or spin coating, or by dipping, spraying, brushing or by any other method which is conventional in the art. The formulation can be applied as one which contains or does not contain a diluting solvent.

The thickness of the various coatings will vary depending upon which coating, e.g., make coat, size coat, etc., and upon the nature of the specific formulation employed. It is within the skill of the art to vary these thicknesses to achieve the desired properties of the coating.

The backing for the abrasive can be any of those conventional in the art such as cloth, paper, polymeric film, vulcanized rubber or a combination of these. Tyvek®, untreated Mylar® and Dupont J-treated Mylar® films may be particularly mentioned.

The ionizing irradiation cured binder formulation of the present invention may, as indicated above, be used as any layer of the coated abrasive product. It may also be used in combination with more conventional and previously employed layers. For example, an abrasive product of the invention may possess the binder formulation of the present invention which is EB cured as the make coat and a more conventional size coat which is UV radiation cured. Also a backing material which has previously been provided with face coat and back coat and cured by conventional means can be used and a make coat comprising the instant binder formulation can be applied thereto and cured by, for example, EB.

Cure (crosslinking) of the epoxide functionality in the subject abrasive binder formulation will be by exposure to ionizing irradiation. When the ionizing radiation source is an Electron Beam (EB) accelerator, the accelerator voltage can be between 150 keV to 10 million eV. The applied dose per pass can range from 1 mrad to 20 mrad. The accelerator may be pulsed or continuous.

The subject abrasive binder formulation may be cured either after each binder layer is applied or after two or more layers are applied. Layer(s) may be undercured to "set" prior to the application of subsequent layers, with the final cure achieved by irradiation of the subsequent layer(s). Radiation may be applied either from the top or through the base of the abrasive (through the backing), although it is anticipated that cure through the back of the coated abrasive article may result in some degradation of the backing material.

Optional thermal post-cure of the irradiated layer may be accomplished in one or several steps.

Layers not exposed to ionizing radiation may be cured thermally or by UV or visible radiation, that is, non-particulate radiation having a wavelength within the range of 200 to 700 nanometers.

From the foregoing discussion, it will be seen that the present invention provides an improvement in previously known coated abrasive products or systems in which at least one layer of said coated abrasive product, including the make coat, the size coat, the super-size coat, the front fill, the back fill and the saturant coat, is an ionizing irradiation cured epoxy resin formulation as described herein.

Having described the invention, the following examples are set forth to more specifically illustrate the invention. These examples are purely illustrative and are not to be interpreted as being exhaustive of the invention. Percentage (%) values given are percent by weight.

It was demonstrated that calcium carbonate can be used as filler, as formulation EB-17, which contained 18.6% calcium carbonate, 78% GY 6010 and 1.9% OPPI, cured tack free when irradiated by 175 keV, 8 mrad.

Knoop hardness numbers for various EB cured epoxy resins were measured. An important factor of cured resole phenolic previously employed in coated abrasive products is their high Knoop hardness (40 to 50 for unfilled resin) and high Tg. The subject EB cured cationic resins exhibit excellent Knoop hardness numbers (KHN) and high Tg's on EB or γ-irradiation cure as shown in TABLE A and TABLE B below.

The Knoop hardness values were measured on a Wilson Tukon Model 300 Microhardness Tester. Samples for hardness testing were produced by coating the uncured formulations on Mylar® sheets with Meyer rods and EB curing at the indicated dose.

TABLE A

| Formulation | Voltage/Applied Dose | Example # | Knoop Hardness |
|---|---|---|---|
| Tactix 556 (96%) THF (2.2%) OPPI (2.1%) | 195 keV/ 10 mrad (2 pass, top and bottom) | A-1 | 40 |
| Tactix 742 (96%) THF (2.0%) OPPI (2.0%) | 195 keV/ 10 mrad (2 pass, top and bottom) | A-2 | 28 |
| Epon 862 (96%) THF (2.0%) OPPI (2.0%) | 195 keV/ 10 mrad (2 pass, top and bottom) | A-3 | 25 |
| GY 6010/OPPI/DVE-3 (96/1.9/1.9) | 195 keV, 10 mrad | A-4 | 37 |
| PY307-1/OPPI/DVE-3 (96/1.9/1.9) | 195 keV, 10 mrad | A-5 | 42 |
| GY6010/CYC M100/ OPPI/DVE-3 (76.9/19.2/1.9/1.9) | 195 keV, 10 mrad | A-6 | 44 |
| DEN431/CYC M100/ OPPI/DVE-3 (76.9/19.2/1.9/1.9) | 195 keV, 6 mrad | A-7 | 43 |
| GY6010/Syloid 74 × 4500/OPPI/DVE-3 (74/14.8/1.9/1.9) | 175 keV, 8 mrad | A-8 | 40 |
| GY285/Syloid 74 × 4500/OPPI/DVE-3 (74/14.8/1.9/1.9) | 175 keV, 8 mrad | A-9 | 47 |
| GY6010/Poly BD 605/OPPI/DVE-3 (80/16.3/1.9/1.9) | 175 keV, 8 mrad | A-10 | 40 |
| GY6010/TCD-Alcohol DM/OPPI/DVE-3 (80/16/1.9/1.9) | 175 keV, 8 mrad | A-11 | 34 |
| GY285/OPPI/DVE-3 (96/1.9/1.9) | 175 keV, 8 mrad | A-12 | 40 |
| DEN431/OPPI/DVE-3 (96/1.9/1.9) | 175 keV, 8 mrad | A-13 | 41 |

For the materials employed in the tests reported in TABLE A, the following information is provided:

| Abbreviation | Source | Composition |
|---|---|---|
| Tactix 556 | Dow Chemical Company | Glycidyl ether of condensation product of dicyclopentadiene and phenol |
| THF | Aldrich | Tetrahydrofuran |
| OPPI | GE Silicones | Experimental product 479-2992c (4-octyloxyphenyl)-phenyl-iodonium hexafluoroantimonate |
| Tactix 742 | Dow Chemical Company | Triglycidyl ether of tris(hydroxyphenyl)methane |
| EPON 862 | Shell Chemical Company | Diglycidyl ether of Bisphenol F |
| GY 6010 | Ciba Polymers | Diglycidyl ether of Bisphenol A |
| DVE-3 | International Specialty Products | Triethyleneglycol divinyl ether |
| PY307-1 | Ciba Polymers | Epoxy phenol novolac |
| CYC M100 | Daicel Chemical Industries, Ltd. | (3,4-epoxycyclohexyl)methyl methacrylate |
| SYLOID ® 74 × 4500 | W. R. Grace and Co. | micron-sized silica gel |
| GY 285 | Ciba Polymers | Diglycidyl ether of Bisphenol F |
| Poly BD 605 | Elf Atochem North America | Polybutadiene, hydroxy terminated |
| TCD-Alcohol DM | | dicyclopentadiene diol |
| DEN 431 | Dow Chemical Company | Epoxy phenol novolac |

The subject EB or γ-irradiation cured resins also exhibit excellent thermal properties on EB cure as shown in the following TABLE B.

TABLE B

Thermal Properties of Subject EB Cured Resins

| Formulation ( ) % by wt. values | Tg (tan δ) °C. | Service Temperature °C.* | Modulus (E") GPa |
|---|---|---|---|
| Tactix 556 (60)/Tactix 123 (40)/OPPI 2 phr | 206 | 182 | 2.29 |
| Tactix 556/OPPI 3 phr | 216 | 187 | 2.25 |
| Tactix 742/OPPI 2 phr | — | 226 | 1.51 |
| Tactix 742 (75)/DER 383 (25)/OPPI 2 phr | 242 | 203 | 1.41 |
| DER 383/OPPI 2 phr | 183 | 143 | 1.29 |
| ERL 4205/OPPI 2 phr | 148 | 133 | 1.46 |
| ERL 4205 (50)/ | 192 | 147 | 1.30 |

TABLE B-continued

| Formulation ( ) % by wt. values | Thermal Properties of Subject EB Cured Resins Tg (tan δ) °C. | Service Temperature °C.* | Modulus (E") GPa |
|---|---|---|---|
| Bis A (50) OPPI 3 phr | | | |
| Epon 862/OPPI 2 phr | 161 | 128 | 1.38 |
| CY179/OPPI 1 PHR | 223 | 161 | 1.30 |
| DEN 438/OPPI 3 PHR | 208 | 159 | 1.29 |

*Temperature at which the modulus falls to ½ its value at 25° C.

For the materials employed in TABLE B, the following information is provided.

| Abbreviation | Source | Composition |
|---|---|---|
| Tactix 556 | Dow Chemical Company | Glycidyl ether of condensation product of dicyclopentadiene and phenol |
| Tactix 123 | Dow Chemical Company | Diglycidyl ether of Bisphenol A |
| OPPI | GE Silicones | Experimental product 479-2992c (4-octyloxyphenyl)-phenyl-iodonium hexafluoroantimonate |
| Tactix 742 | Dow Chemical Company | Triglycidyl ether of tris (hydroxyphenyl)methane |
| DER 383 | Dow Chemical Company | Diglycidyl ether of Bisphenol A |
| ERL 4205 | Union Carbide Chemical Co. | bis(2,3-epoxycyclopentyl)ether |
| EPON 862 | Shell Chemical Company | Diglycidyl ether of Bisphenol F |
| CY 179 | Ciba Polymers | 3',4'-epoxycyclohexylmethyl-3,4-epoxycyclohexane carboxylate |
| DEN 438 | Dow Chemical Company | Epoxy phenol novolac |

WORKING EXAMPLES

Samples of Coated Abrasive products were made using EB Cured Epoxy Resins:

Epoxy formulations used for "make coat" were coated onto (a) Untreated Mylar® film and (b) Dupont J-treated Mylar® film (grade 500J101).

The make coat was applied at room temperature with a BYK Gardner bar type applicator.

Make coats were applied in two sections to 8½×11 inch Mylar® sheets to a wet thickness of 2 and 4 mils.

Abrasive grit was applied to the wet (uncured) resin coated sheet by hand, and the excess abrasive grit shaken off.

Abrasive grit was 220 (grit) untreated silicon carbide from the K.C. Abrasive Company, Kansas City, Kans. 66115. (One sample abrasive was made with 180 grit silicon carbide abrasive from the same source.)

All abrasive sheets were EB cured at 175 keV, 8 mrad.

Although all sheets were tack-free in two minutes or less after one pass at 8 mrad, some were passed under the EB a second time at 8 mrad.

Some sheets were post cured at 93° C. for 90 minutes.

After cure of the make coat, a size coat (top coat) was applied over the make coat layer holding the abrasive grit. This was brush coated with a disposable paintbrush.

The size coat was cured by (A) UV (Fusion curing system, 2 "H" bulbs), or (B) EB (175 keV, 8 mrad).

For UV cure of size coat, two basic size coat formulations were used: one contained Uvacure 1500+sulfonium salt initiator, the other contained GY 6010/Uvacure 1500 (2/1) +sulfonium salt initiator.

For EB cure of size coat, three different size coat formulations were used: two contained Uvacure 1500+initiator (iodonium salt or sulfonium salt), one contained GY 6010/Uvacure 1500 (2/1)+iodonium salt.

The UV cured size coats were initially applied in sections to compare the sanding ability of the coated abrasive; one section was coated with the GY 6010/Uvacure 1500 formulation, one section was uncoated, one section was coated with the Uvacure 1500 formulation.

The EB cured size coats were applied in sections to compare the sanding ability of the coated abrasive: one section was coated with the Uvacure 1500+sulfonium salt formulation, one section was uncoated and one section was coated with the Uvacure 1500+iodonium salt formulation.

To verify that Bisphenol A type epoxies could be used for size coats as well, one coated abrasive article was size coated with the formulation containing GY 6010, Uvacure 1500 and iodinium salt initiator.

The resulting coated abrasive was tested on wood, polyethylene, aluminum and steel.

| Size Coat Designation | Size Coat Composition ( ) % by weight |
|---|---|
| SC-1 | GY6010(64)/Uvacure 1500(32)/Cyracure UVI 6974 (Triaryl sulfonium salt) (3.8) |
| SC-2 | Uvacure 1500 (96)/Cyracure UVI 6974 (Triaryl sulfonium salt) (3.8) |
| SC-3 | Uvacure 1500 (98)/OPPI (Diaryl iodonium salt) (2) |
| SC-4 | GY6010(65.3) /Uvacure 1500 (31.1)/OPPI (Diaryl iodonium salt) (1.9)/DVE-3 (1.6) |

UV Cured Size Coats:

EB Cured Coated Abrasives with UV Cured Size Coats

| Coated Abrasive Designation | # Passes for EB Cure of Make Coat @ 175 keV, 8 mrad | 90 min Thermal post-cure of make coat @ 93° C. | Cure Dose of Section Size Coated with SC-1 | Cure Dose of Section Coated with SC-2 |
|---|---|---|---|---|
| UV-1 | one | yes | 30 fpm, 2H bulb | 30 fpm, 2H bulb |
| UV-2 | one | yes | 30 fpm, 2H bulb | 30 fpm, 2H bulb |
| UV-3 | one | yes | 30 fpm, 2H bulb | 30 fpm, 2H bulb |
| UV-4 | one | yes | 30 fpm, 2H bulb | 30 fpm, 2H bulb |
| UV-5 | one | no | 30 fpm, 2H bulb | 60 fpm, 2H bulb |
| UV-6 | one | yes | 30 fpm, 2H bulb | 60 fpm, 2H bulb |
| UV-7 | one | yes | 30 fpm, 2H bulb | 60 fpm, 2H bulb |
| UV-8 | one | yes | 30 fpm, 2H bulb | 60 fpm, 2H bulb |
| UV-9 | two | no | no 223A coat applied | 2 passes at 30 fpm, 1H |

Make Coat Compositions for EB Cured Coated Abrasives with UV Cured Size Coats

| Coated Abrasive Designation | Make Coat Compositions ( ) % by weight | Make coat Composition Designation |
|---|---|---|
| UV-1 | GY6010(96)/OPPI (1.9)/DVE-3(1.9) | MC-1 |
| UV-2 | GY6010(79.9)/Poly BD605 (16.3)/ OPPI(1.9)/DVE-3 (1.9) | MC-2 |
| UV-3 | GY6010(87.4)/TCD Alcohol DM (8.7)/OPPI(1.9)/DVE-3 (1.9) | MC-3 |
| UV-4 | GY6010(80.1)(/Atochem 99-042 (16)/OPPI(1.9)/DVE-3 (1.9) | MC-4 |
| UV-5 | GY6010(79.9)/Poly BD605 (16.3)/ OPPI(1.9)/DVE-3(1.9) | MC-5 |
| UV-6 | GY6010(74)/Syloid 74 × 4500 (14.8)/CYC M100(7.4)/OPPI(1.9)/ DVE-3(.1.9) | MC-6 |
| UV-7 | GY285(96)/OPPI(1.9)/DVE-3(1.9) | MC-7 |
| UV-8 | DEN 431(96)/OPPI(1.9)/DVE-3(1.9) | MC-8 |
| UV-9 | GY285(74)/Syloid 74 × 4500 (14.8)/CYC M100(7.4)/OPPI(1.9)/ DVE-3(1.9) | MC-9 |

| Coated Abrasive Designa- | Non-size coated | SC-1 size coated section | SC-2 size coated section | | | |
|---|---|---|---|---|---|---|
| nation | section | Wood | Wood | Plastic | Aluminum | Steel |
| UV-1 | A | S | S | S | S | S |
| UV-2 | A | size coat too thick | S+ | S | S | S |
| UV-3 | A | size coat too thick | S | S | S | S |
| UV-4 | A | size coat too thick | S | S | S | S |
| UV-5 | B | size coat too thick | S | S | S | S |
| UV-6 | B | S | S | S | | |
| UV-7 | A | S | S | | | |
| UV-8 | B+ | S | S+ | S | S | S |
| UV-9 | A | not done | S+ | S | S | S |

•The non-size coated sections of the samples did not sand the wood well (abrasive grit was removed faster than wood in most cases.)

Results of Sanding Tests for EB Cured Coated Abrasives with UV Cured Size Coats

EB Cured Size Coats:

All EB cured size coats were cured by one pass at b 175keV, 8 mrad.

All EB cured size coated samples were tack-free 15 seconds or less after exposure.

This included the samples using the sulfonium salt initiator (UVI 6974), which is reported to be much less effective than the iodonium salt initiators for EB use.

EB Cured Coated Abrasives with EB Cured Size Coats

| Coated Abrasive Designation | EB dose of Make Coat at 175 keV | Make coat Composition Designation | Make Coat Composition ( ) % by weight | Substrate |
|---|---|---|---|---|
| EB-1 | 8 mrad | MC-1 | GY6010(96)/OPPI(1.9)/ DVE-3(1.9) | Untreated Mylar |
| EB-2 | 8 mrad | MC-7 | GY285(96)/OPPI(1.9)/ DVE-3(1.9) | Untreated Mylar |
| EB-3 | 8 mrad | MC-3 | GY6010(87.4)/TCD Alcohol DM(8.7)/OPPI(1.9)/DVE-3(1.9) | Untreated Mylar |
| EB-4 | 8 mrad | MC-6 | GY6010(74)/Syloid 74 × 4500 (14.8)/CYC M100(7.4)/OPPI (1.9)/DVE-3(1.9) | Untreated Mylar |
| EB-5 | 8 mrad | MC-4 | GY6010(80.1)/Atochem 99-042(16)/OPPI(1.9)/DVE-3 (1.9) | Untreated Mylar |
| EB-6 | 8 mrad | MC-1 | GY6010(96)/OPPI(1.9)/ DVE-3(1.9) | Untreated Mylar |
| EB-7 | 8 mrad | MC-3 | GY6010(87.4)/TCD Alcohol DM(8.7)/OPPI(1.9)/DVE-3 (1.9) | Untreated Mylar |

-continued

| Coated Abrasive Designation | EB dose of Make Coat at 175 keV | Make coat Composition Designation | Make Coat Composition ( ) % by weight | Substrate |
|---|---|---|---|---|
| EB-8 | 2 passes at 8 mrad | MC-2 | GY6010(79.9)/Poly BD605 (16.3)/OPPI(1.9)/DVE-3 (1.9) | DuPont 500J101 surface treated Mylar |
| EB-9 | 2 passes at 8 mrad | MC-1 | GY6010(96)/OPPI(1.9)/ DVE-3(1.9) | DuPont 500J101 surface treated Mylar |
| EB-10 | 2 passes at 8 mrad | MC-6 | GY6010(74)/Syloid 74 × 4500 (14.8)/CYC M100(7.4)/OPPI (1.9)/DVE-3(1.9) | DuPont 500J101 surface treated Mylar |
| EB-11 | 8 mrad | MC-10 | GY6010(96)/OPPI(1.9)/ DVE-3(1.9) | DuPont 500J101 surface treated Mylar |
| EB-12 | 8 mrad | MC-10 | GY6010(96)/OPPI(1.9)/ DVE-3(1.9) | DuPont 500J101 surface treated Mylar |
| EB-13 | 8 mrad | MC-7 | GY285(96)/OPPI(1.9)/ DVE-3(1.9) | DuPont 500J101 surface treated Mylar |
| EB-14 | 8 mrad | MC-7 | GY285(96)/OPPI(1.9)/ DVE-3(1.9) | DuPont 500J101 surface treated Mylar |
| EB-15 | 8 mrad | MC-8 | DEN431(96)/OPPI(1.9)/ DVE-3(1.9) | DuPont 500J101 surface treated Mylar |
| EB-16 | 8 mrad | MC-6 | GY6010(74)/Syloid 74 × 4500 (14.8)/CYC M100(7.4)/OPPI (1.9)/DVE-3(1.9) | DuPont 500J101 surface treated Mylar |

Abrasive Behavior:

All abrasives (but one) with EB cured size coat were divided into three parts. One part was size coated with SC-2, one part was size coated with SC-3, and the remaining ⅓ of the abrasive was not size coated. Abrasive sample EB-7 had two parts of the surface coated with SC-4 and the remaining part of the abrasive was not size coated.

Results of Sanding Tests for EB Cured Coated Abrasives with EB Cured Size Coats

| Coated Abrasive | SC-2 size coated section | | | | SC-3 size coated section | | | |
|---|---|---|---|---|---|---|---|---|
| Designation | Wood | Plastic | Aluminum | Steel | Wood | Plastic | Aluminum | Steel |
| EB-1 | S | S | S | B | S | S | S | B |
| EB-2 | S | S | S | B | S | S | S | B |
| EB-3 | S | S | S | B | S | S | S | B |
| EB-4 | S | S | S | B | S | S | S | B |
| EB-5 | S | S | S | B | S | S | S | B |
| EB-6 | S | S | S | B | S | S | S | B |
| EB-8 | S | S | S | B | S | S | S | B |
| EB-9 | S | S | S | B | S | S | S | B |
| EB-10 | S | S | S | B | S | S | S | B |
| EB-11 | S | S | S | B | S | S | S | B |
| EB-12 | S | S | S | B+ | S | S | S | B+ |

-continued

| Coated Abrasive | SC-2 size coated section | | | | SC-3 size coated section | | | |
|---|---|---|---|---|---|---|---|---|
| Designation | Wood | Plastic | Aluminum | Steel | Wood | Plastic | Aluminum | Steel |
| EB-13 | S | S | S | B+ | S | S | S | B+ |
| EB-14 | S | S | S | B | S | S | B | B |
| EB-15 | S | S | S | B+ | S | S | S | B |
| EB-16 | B+ | S | S | B | B+ | S | B | B |

A) Grit removed, no or minimal work removed. (A− is worse than A).
B) Some grit removed but some work removed also. (B+ is better than B).
S) Sands work without loss of grit.
EB-7: Coated with SC-4, sanded wood, plastic and aluminum. Sanded steel with loss of grit (B). Un-size coated portion sanded with loss of grit (B).

Wood Sanding Test Results for non-Size Coated Abrasive

| Coated Abrasive Designation | Result | Coated Abrasive Designation | Result | Coated Abrasive Designation | Result |
|---|---|---|---|---|---|
| EB-1 | A | EB-6 | B | EB-12 | A |
| EB-2 | B | EB-8 | A | EB-13 | A |
| EB-3 | A | EB-9 | B | EB-14 | A− |
| EB-4 | B | EB-10 | B | EB-15 | B |
| EB-5 | A | EB-11 | B+ | EB-16 | A |

A) Grit removed, no or minimal work removed (A− is worse than A).
B) Some grit removed but some work removed also. (B+ is better than B).
• All EB cured size coated samples were tack-free 15 seconds or less after exposure.
• The non-size coated samples did not sand the wood well (abrasive grit was removed faster than wood in most cases).

In respect to the materials employed in the Working Examples, the following information is provided:

| Abbreviation | Source | Composition |
|---|---|---|
| GY*p343X6010 | Ciba Polymers | Diglycidyl ether of Bisphenol A |
| Uvacure 1500 | UCB Radcure | 3',4'-epoxycyclohexyl methyl 3,4-epoxycyclo-hexane carboxylate |
| Cyracure UVI 6974 | Union Carbide Chemicals and Plastics | Mixed Triaryl sulfonium salts, $SbF_6^-$ counterion, in 50% propylene carbonate |
| OPPI | GE Silicones | Experimental product 479-2992C (4-octyloxyphenyl) -phenyl-iodonium hexa-fluoroantimonate |
| DVE-3 | International Specialty Products | Triethyleneglycol divinyl ether |
| Poly BD 605 | Elf Atochem North America | Polybutadiene, hydroxy terminated |
| TCD Alcohol DM | — | di-cyclopentadiene diol |
| Atochem 99-042 | Elf Atochem North America | Experimental olefin with cycloaliphatic epoxide functionality |
| SYLOID ® 74 × 4500 | W. R. Grace and Co. | micron-sized silica gel |
| CYC M100 | Daicel Chemical Industries, Ltd. | (3,4-epoxycyclohexyl) methyl methacrylate |
| GY285 | Ciba Polymers | Diglycidyl ether of Bisphenol F |
| DEN 431 | Dow Chemical Company | Epoxy phenol novolac |

What is claimed is:

1. In a coated abrasive product which comprises a backing with abrasive granules supported thereby and adhered thereto, a make coat of a resinous binder and a size coat of a resinous binder and, optionally, having a saturant coat or a presize coat or a backsize coat or a combination of said optional coats, the improvement wherein at least one coat of the coated abrasive product is an ionizing irradiation curable epoxy resin formulation which comprises at least one epoxy resin or precursor thereof in an amount of 1 to 99.5% by weight of the total formulation and a cationic onium salt initiator in an amount of 0.1 to 10% by weight of the total formulation.

2. A coated abrasive product according to claim 1 wherein the ionizing irradiation is selected from the group consisting of electron beam, gamma ray and X-ray.

3. A coated abrasive product according to claim 2 wherein the ionizing irradiation is electron beam.

4. A coated abrasive product according to claim 3 wherein at least the make coat is the said epoxy resin formulation.

5. A coated abrasive product according to claim 4 wherein the size coat is the said epoxy resin formulation.

6. A coated abrasive product according to claim 4 wherein the size coat is a UV curable epoxy resin formulation.

7. A coated abrasive product according to claim 6 wherein the size coat is a UV curable epoxy resin of 3',4'-epoxycyclohexylmethyl 3,4-epoxycyclohexane carboxylate.

8. A coated abrasive product according to claim 4 wherein the epoxy resin of the make coat is diglycidyl ether of bisphenol A.

9. A coated abrasive product according to claim 4 wherein the epoxy resin of the make coat is a mixture of diglycidyl ether of bisphenol A and hydroxy terminated polybutadiene.

10. A coated abrasive product according to claim 4 wherein the epoxy resin of the make coat is diglycidyl ether of bisphenol F.

11. A coated abrasive product according to claim 4 wherein the epoxy resin of the make coat is epoxy phenol novolac resin.

12. A coated abrasive product according to claim 1 wherein the ionizing irradiation curable epoxy resin formulation additionally contains at least one member selected from the group consisting of 0 to 40% by weight of a reactive diluent, 0 to 20% by weight of an alcohol, 0 to 50% by weight of a polyol, 0 to 40% by weight of a phenolic compound, 0 to 90% by weight of a solvent, 0 to 70% of a mineral filler, 0 to 50% by weight of abrasive particles, 0 to 30% by weight of a reactive or non-reactive toughening agent, 0 to 10% by weight of a thermally activated cationic initiator and 0 to 10% by weight of a pigment or dye.

13. A coated abrasive product according to claim 1 wherein the cationic onium salt initiator is a diaryl-iodonium salt of the formula

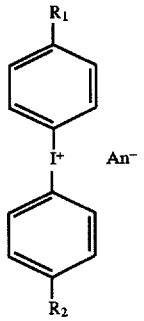

wherein $R_1$ and $R_2$ are H, methyl, ethyl, n-propyl, isopropyl, n-butyl, tert-butyl, Cl, Br, $C_nH_{2n+1}$, $OC_nH_{2n+1}$, $OCH_2CH(CH_3)C_nH_{2n+1}$, $OCH_2CH(C_2H_5)C_nH_{2n+1}$, $OCH_2CH(OH)C_nH_{2n+1}$, $OCH_2CO_2C_nH_{2n+1}$, $OCH(CH_3)CO_2C_nH_{2n+1}$, $OCH(C_2H_5)CO_2C_nH_{2n+1}$, and mixtures thereof where n is an integer between 0 and 18, and $An^-$ is an anion selected from the group consisting of $AsF_6$, $SbF_6$, $PF_6$, $BF_4$, $CF_3SO_3$, $B[C_6F_5]_4$ and $B[C_6H_3(CF_3)_2]_4$.

14. A coated abrasive product according to claim 13 wherein the initiator is (4-octyloxyphenyl)-phenyliodonium hexafluoroantimonate.

15. A coated abrasive product according to claim 1 wherein the epoxy resin is selected from the group consisting of diglycidyl ethers of bisphenol A, diglycidyl ethers of bisphenol F, epoxy phenol novolacs, epoxy cresol novolacs, bisphenol A epoxy novolacs, tetraglycidyl ether of tetrakis (4-hydroxyphenyl)ethane, glycidyl ethers of the condensation product of diclopentadiene and phenol, triglycidyl ether of tris(hydroxyphenyl)methane, and mixtures thereof.

16. A coated abrasive product according to claim 1 wherein the epoxy resin is a diglycidyl ether of bisphenol A and the cationic onium salt initiator is (4-octyloxyphenyl)-phenyl-iodonium hexafluoroantimonate.

* * * * *

UNITED STATES PATENT AND TRADEMARK OFFICE

CERTIFICATE OF CORRECTION

PATENT NO. : 5,730,764

DATED : March 24, 1998

INVENTOR(S) : SUE ELLEN WILLIAMSON and RICHARD R. KEMMERER

It is certified that error appears in the above-identified patent and that said Letters Patent is hereby corrected as shown below:

Column 3, line 27, after "Company" insert a comma (,).

Column 7, lines 35 - 39, the formula should read as follows:

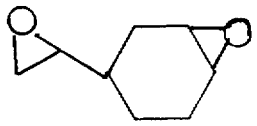

UNITED STATES PATENT AND TRADEMARK OFFICE

CERTIFICATE OF CORRECTION

PATENT NO. : 5,730,764

DATED : March 24, 1998

INVENTOR(S) : SUE ELLEN WILLIAMSON and RICHARD R. KEMMERER

It is certified that error appears in the above-indentified patent and that said Letters Patent is hereby corrected as shown below:

Column 10, lines 45 - 50 should read as follows:

--$An^-$ denotes the anion which may be hexafluoroarsenate $(AsF_6)^-$, hexafluoroantimonate $(SbF_6)^-$, hexafluorophosphate $(PF_6)^-$, boron tetrafluoride $(BF_4)^-$, trifluoromethane sulfonate $(CF_3SO_3)^-$, tetrakis (pentafluorophenylborate), $(B[C_6F_5]_4)^-$, or tetrakis [3,5-bis(trifluoromethyl)phenyl]borate $(B[C_6H_3(CF_3)_2]_4)^-$. For example, OPPI used in the examples herein--.

UNITED STATES PATENT AND TRADEMARK OFFICE

CERTIFICATE OF CORRECTION

PATENT NO. : 5,730,764

DATED : March 24, 1998

INVENTOR(S) : SUE ELLEN WILLIAMSON and RICHARD R. KEMMERER

It is certified that error appears in the above-identified patent and that said Letters Patent is hereby corrected as shown below:

Column 11, line 44 should read --type of reactive functionality in the same molecule.--.

Column 16, line 64, change "223A" to --SC-1--.

Column 17, lines 23 - 24 should read --Results of Sanding Tests for EB Cured Coated Abrasives with UV Cured Size Coats--;

lines 43 - 46, insert the following:

--A) Grit removed, no or nominal word removed. (A- is worse than A)

B) Some grit removed but some work removed also. (B+ is better than B)

S) Sands work without loss of grit.--

UNITED STATES PATENT AND TRADEMARK OFFICE

CERTIFICATE OF CORRECTION

PATENT NO. : 5,730,764

DATED : March 24, 1998

INVENTOR(S) : SUE ELLEN WILLIAMSON and RICHARD R. KEMMERER

It is certified that error appears in the above-identified patent and that said Letters Patent is hereby corrected as shown below:

Column 18, lines 1 and 2 should be deleted;

line 10, delete the term "b";

line 15, insert a bullet (•) before "All";

line 17, insert a bullet (•) before "This".

Column 21, line 15, insert --• All EB cured sized coated samples were tack-free 15 seconds or less after exposure.--;

lines 29 and 30 should be deleted;

line 38, change "GY*p343X6010" to --GY 6010--.

Column 22, line 42, change "is diglycidyl" to --is a diglycidyl--;

line 48, change "is diglycidyl" to --is a diglycidyl--;

line 50, change "is epoxy" to --is an epoxy--.

UNITED STATES PATENT AND TRADEMARK OFFICE

CERTIFICATE OF CORRECTION

PATENT NO. : 5,730,764 Page 5 of 5

DATED : March 24, 1998

INVENTOR(S) : SUE ELLEN WILLIAMSON and RICHARD R. KEMMERER

It is certified that error appears in the above-indentified patent and that said Letters Patent is hereby corrected as shown below:

Column 24, lines 1 and 2 should read --from the group consisting of $AsF_6^-$, $SbF_6^-$, $PF_6^-$, $BF_4^-$, $CF_3SO_3^-$, $B[C_6F_5]_4^-$ and $B[C_6H_3(CF_3)_2]_4^-$.--.

Signed and Sealed this

Eleventh Day of January, 2000

*Attest:*

Q. TODD DICKINSON

*Attesting Officer*

*Acting Commissioner of Patents and Trademarks*